United States Patent [19]

Nitta

[11] Patent Number: 4,929,175

[45] Date of Patent: May 29, 1990

[54] NONCONTROLLING TYPE VALVE

[75] Inventor: Tomio Nitta, Yokohama, Japan

[73] Assignee: Tokai Corporation, Yokohama, Japan

[21] Appl. No.: 342,199

[22] Filed: Apr. 24, 1989

[30] Foreign Application Priority Data

Apr. 27, 1988 [JP] Japan ..... 63-55863[U]

[51] Int. Cl.[5] ..... F23D 14/28

[52] U.S. Cl. ..... 431/344; 137/550; 222/3

[58] Field of Search ..... 137/544, 545, 550, 454.2; 222/3; 431/344

[56] References Cited

U.S. PATENT DOCUMENTS

| | | | |
|---|---|---|---|
| 3,399,951 | 9/1968 | Koizumi | 431/344 |
| 3,418,821 | 12/1968 | Remy et al. | 431/344 X |
| 3,663,152 | 5/1972 | Yoshida | 222/3 X |
| 4,101,262 | 7/1978 | Neyret | 431/344 |
| 4,153,233 | 5/1979 | Neyret | 431/344 X |
| 4,289,478 | 9/1981 | Nitta | 431/344 |
| 4,496,309 | 1/1985 | Schächter | 431/344 |

FOREIGN PATENT DOCUMENTS

| | | | |
|---|---|---|---|
| 2397599 | 3/1979 | France | 431/344 |

*Primary Examiner*—John Rivell

*Attorney, Agent, or Firm*—Armstrong, Nikaido, Marmelstein, Kubovcik & Murray

[57] ABSTRACT

A noncontrolling type valve comprised, in the recess of the top plate of a gas container, valve means, a filter positioned below the valve means to permit a given constant flow of gas to pass to the valve means when opened, an annular spacer fixed to the filter and a net structure sandwiched between the filter and the bottom of the valve. The net structure is to prevent any displacement or deformation of the gas flow controlling filter, which displacement or deformation would be otherwise caused if the filter is exposed to an increased gas pressure, and then the valve could not keep the gas flow rate constant, and hence the flame length constant and stable. The filter can be put in position simply by push-fitting an associated annular spacer in the recess.

2 Claims, 2 Drawing Sheets

NONCONTROLLING TYPE VALVE

BACKGROUND OF THE INVENTION

1. Field of the Invention

The present invention relates to a noncontrolling type valve for use in a gaslighter, a portable cooking stove and other burners. Such a valve permits a given constant amount of gas to flow to the nozzle when the valve opens.

2. Related Art

A conventional noncontrolling type valve is built in a recess integrally formed in the top plate of a gas container. The recess has a through aperture in its bottom to communicate with the inside of the gas container. A valve means is push-fitted in the recess, and a porous filter is positioned below the valve means to close the through aperture of the recess bottom, thereby permitting a given constant amount of gas to flow from the through aperture of the recess bottom to the valve when it is opened. The porous filter is separate from the recess bottom and from the valve bottom. When the valve is opened, the porous filter will be subjected to gas pressure, and accordingly it will be yieldingly bent upwards. Thus, it is liable to be loosened or deformed. Sometimes, the filter comes close to the valve bottom to change the gas-passing area of the filter. These will cause the gas to pass through the valve at different flow rates.

Generally, noncontrolling type vales are designed to handle the gasphase flow. In place of gas, however, the liquid comes to contact the filter occasionally, and then it will apply to the filter a pressure which is stronger than the gas, and accordingly the filter will be liable to deform larger. In fact, the atmosphere surrounding the filter changes from gas to liquid phase and vice versa. In addition to this, considerations must be paid to the effects on the gas flow rate passing through the filter and the flame length extending from the nozzle, which effects are caused by different factors such as the liquid level when the lighter is turned upside down, the temperature of the filter when the liquid comes to contact the filter etc.

SUMMARY OF THE INVENTION

In view of the above one object of the present invention is to provide a noncontrolling type valve guaranteed free from deformation of an associated filter, and hence change of gas flow rate and change of the flame height.

To attain this object a noncontrolling type valve comprising a recess formed in the top plate of a gas container, said recess having a through aperture in its bottom to communicate with the inside of said gas container; valve means push-fitted in said recess; and a filter positioned below said valve means to permit a given constant flow of gas to pass to said valve when opened, is improved according to the present invention in that it further comprises, in said recess, an annular spacer fixed to said filter and a net structure sandwiched between said filter and the bottom of said valve. The annular spacer may be fixed to the filter by thermocompression bonding, ultrasonic welding or impulse welding.

With this arrangement the gas from the liquefied petroleum gas well passes through the aperture in the recess bottom and then through the membrane filter. The gas flow rate depends on the area of the filter and the mesh size of the overlying net structure. These sizes are selected to produce, for instance a 25 millimeter long flame at room temperature. After passing through the net structure, the gas enters the valve compartment from the aperture of the valve bottom, and then the gas flow in the channel of the valve stem to eject from the nozzle to the atmosphere.

The net structure is sandwiched between the filter and the valve bottom. Thus, the filter is lined with and supported by the net structure, and therefore even if the gas pressure increases with the increase of the surrounding temperature, the filter cannot be yieldingly bent upward, thus causing no loosening and deformation of the gas filter and assuring that the filtering area remains constant.

The filter is fixed to the annular spacer, and therefore the filter can be easily put in position simply by push-fitting the annular spacer in the recess.

Other objects and advantages of the present invention will be understood from the following descirption of noncontrolling type valves according to preferred embodiments of the present invention, which are shown in accompanying drawings:

PREFERRED EMBODIMENT OF THE INVENTION

Figure 1:
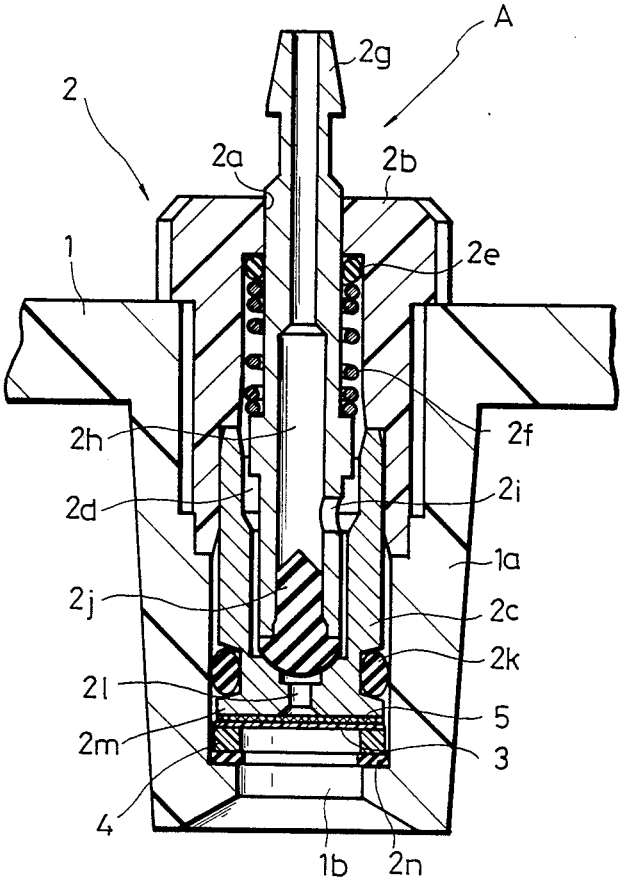
FIG. 1 is a longitudinal section of a noncontrolling type valve according to a preferred embodiment of the present invention.

FIG. 1 shows a noncontrolling type valve A according to a preferred embodiment as being built in the top plate 1 of a gas container (not shown). Specifically the top plate 1 is integrally connected by ultrasonic welding to the gas container casing to hermetically close its top. Liquefied petroleum gas is put in the gas container.

As shown, a recess 1*a* is formed in the top plate 1 of the gas container. The recess has a through aperture 1*b* in its bottom to communicate with the inside of the gas containenr (not shown).

The valve 2 is push-fitted in the recess 1*a*. The valve 2 comprises a cylindrical screw cap 2*b* having an opening 2*a* on its top and threads on its outside, and a cylindrical trunk 2*c* fitted in the bottom of the cylindrical screw cap 2*b*. The cylindrical screw cap 2*b* and the cylindrical trunk 2*c* define a valve compartment 2*d*. A nozzle 2*g* is put in the compartment 2*d* with its tip end 2g projecting from the cylindrical screw cap 2*b*. The nozzle 2*g* is biased downward by a spring 2*f*. An O-ring 2*e* is pushed against the ceiling of the valve compartment 2*d* to hermetically close the gap between the nozzle 2*g* and the cylindrical screw cap 2*b*. The nozzle 2*g* has a longitudinal channel 2*h* and a lateral channel 2*i*. The nozzle 2*g* has a rubber plug 2*j* at its bottom to close its longitudinal channel 2*h*. When the nozzle 2*g* is pulled up, the rubber plug 2*j* rises to open the valve opening 2*l*. An O-ring 2*k* is fitted in the circumferential slot of the lower end of the cylindrical trunk 2*c*.

As seen from FIG. 1, a metal net 5 is applied to the bottom end 2*m* of the cylindrical trunk 2*c*, and a membrane filter 3 is laid on the undersurface of the net structure 5 to permit a given constant flow of gas to pass to the valve. The membrane filter 3 is fixed to an annular spacer 4 of a synthetic resin by thermocompression bonding, ultrasonic welding or impulse welding. The annular spacer 4 bearing the membrane filter 3 is pushfitted in the recess 1*a*. The overlying net structure 5 has an effect to prevent displacement or deformation of the membrane filter 3 even if the gas pressure increases with the increase of temperature to apply an increased pressure to the membrane filter 3, and no displacement or deformation of the membrane filter 3 assures that the gas-passing area of the membrane filter is kept constant to allow a predetermined amount of gas to pass through the membrane filter and that a predetermined height of flame is formed. An unwoven cloth of polypropylene with 75 micron thick is laminated on the upper surface of the membrane filter 3 to keep a constant flow of gas and permit a predetermined height of flame without effect of the change of gas pressure. Preferably, the membrane filter 3 is made of microporous film of polypropylene with 25 micron thick, 0.4×0.04 micron maximum aperture and 38% voids.

A lever (not shown) is swingably supported with its end fixed to the neck of the nozzle 2*g*. When the lever is operated to pull up the nozzle 2*g*, the rubber plug 2*j* rises apart from the valve openign 21 to permit the gas to flow to the membrane filter 3. An annular flat gasket is indicated at 2*n*.

The liquid petroleum gas changes from the liquid to gasous phase on the surface of the gas well. When the valve opens, the gas passes through the aperture 1*b* of the recess bottom, and then through the membrane filter 3 and the net structure 5. The gas flow rate depends on the gas-passing area of the membrane filter 3 and the mesh size of the net structure 5. These factors are determined to form, for instance, a 25 millimeter long flame on the nozzle tip. After passing through the meshes of the net structure 5 the gas flows in the valve opening 21 of the cylindrical turnk 2*c* and then in the valve compartment 2*d*. Then, the gas flows in the laterl and longitudinal channels 2*i* and 2*h* of the valve stem 2*a*.

Figure 2:
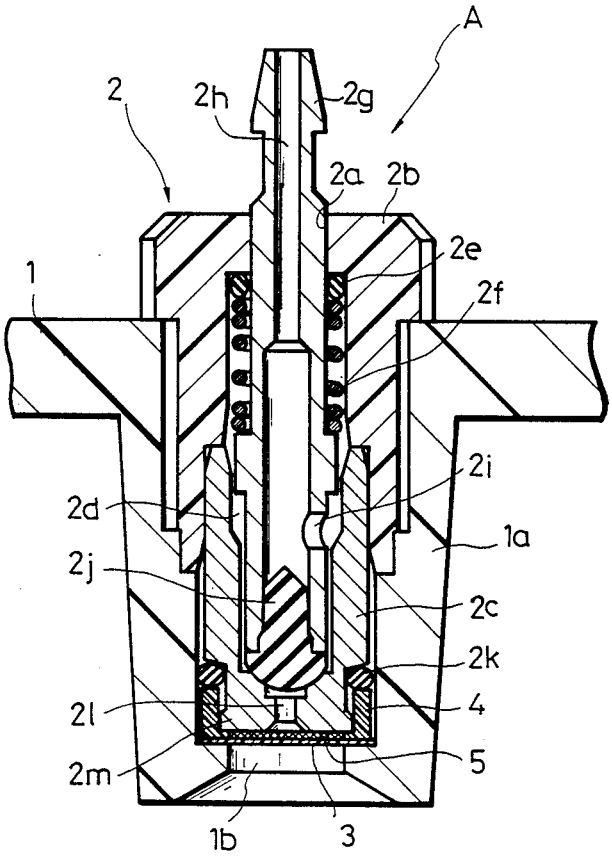
FIG. 2 is a longitudinal section of a noncontrolling type valve according to another embodiment.

FIG. 2 shows a noncontrolling type valve according to a second embodiment of the present invention. As shown, a rimmed annular spacer 4 encircles the bottom end of the cylindrical trunk 2*c*, and a membrane filter 3 is welded to the annular spacer 4. A net structure 5 is fitted in the circular space of the annular ring 4, and is pushed against the bottom end of the cylindrical trunk 2*c*. Also, the net structure 5 is put close to the uppersurface of the membrane filter 3.

An O-ring 2*k* is put in between the annular space 4 and the shoulder of the cylindrical trunk 2*c* to prevent the gas from leaking through the gap between the inside wall of the recess and the cylindrical plug 2*c*.

As may be understood from the above, a noncontrolling type valve according to the present invention uses a net structure to prevent any displacement or deformation of a gas flow controlling filter associated therewith, which displacement or deformation would be otherwise caused if the filter is exposed to an increased gas pressure, and then the valve could not keep the gas flow rate constant, and hence the flame length constant and stable.

The membrane filter can be put in position simply by pushfitting an associated annular spacer in the recess. This is advantageous to automatic assembling.

I claim:

1. A noncontrolling type valve comprising: a recess formed in a top plate of a gas container, said recess having a through aperture in its bottom communicating with the inside of said gas container; valve means pushfitted in said recess; a through aperture in said valve means in alignment with said through aperture in said bottom of said recess; a valve in said valve means for opening and closing said through aperture in said valve means; and, a filter positioned in said recess below said valve means and between said through aperture in said valve means and said through aperture in said bottom of said recess for permitting a given constant flow of gas to pass to said valve means when said valve in said valve means is opened, said filter further comprises, in said recess, an annular spacer fixed to said filter and a net structure sandwiched between said filter and a bottom of said through aperture in said valve means.

2. A noncontrolling type valve according to claim 1 wherein said annular spacer is fixed to said filter.

* * * * *